US012109466B2

(12) United States Patent
Luo

(10) Patent No.: US 12,109,466 B2
(45) Date of Patent: Oct. 8, 2024

(54) ASSEMBLED TYPE GOLF BAG

(71) Applicant: TRI-GREAT INTERNATIONAL LTD., Dongguan (CN)

(72) Inventor: Chunfang Luo, Dongguan (CN)

(73) Assignee: TRI-GREAT INTERNATIONAL LTD., Dongguan (CN)

( * ) Notice: Subject to any disclaimer, the term of this patent is extended or adjusted under 35 U.S.C. 154(b) by 169 days.

(21) Appl. No.: 17/881,525

(22) Filed: Aug. 4, 2022

(65) Prior Publication Data

US 2023/0405423 A1 Dec. 21, 2023

(30) Foreign Application Priority Data

Jun. 15, 2022 (CN) ..... 202221489766.7

(51) Int. Cl.
*A63B 55/40* (2015.01)

(52) U.S. Cl.
CPC ..... *A63B 55/40* (2015.10); *A63B 2210/50* (2013.01)

(58) Field of Classification Search
CPC ..... A63B 55/40; A63B 2210/50
USPC ..... 206/315.6
See application file for complete search history.

(56) References Cited

U.S. PATENT DOCUMENTS 3,674,072 A * 7/1972 Shuto ..... A63B 55/40 206/315.6
4,266,589 A * 5/1981 Cochran ..... A63B 55/50 206/315.3
5,458,240 A * 10/1995 Rich ..... A63B 55/40 206/315.6
5,899,328 A * 5/1999 Dulyea, Sr. ..... A63B 55/40 206/315.6
5,941,383 A * 8/1999 Cheng ..... A63B 55/00 206/315.3
5,971,147 A * 10/1999 Sutter ..... A63B 55/40 206/315.6
6,330,944 B1 * 12/2001 DeMichele ..... A63B 55/408 206/315.6
6,425,589 B1 * 7/2002 Wu ..... A63B 55/60 280/DIG. 6

(Continued)

FOREIGN PATENT DOCUMENTS

CN 1634623 A * 7/2005 ..... A63B 55/00
CN 112691353 A * 4/2021 ..... A63B 55/30

(Continued)

*Primary Examiner* — Robert J Hicks
*Assistant Examiner* — Sanjidul Islam
(74) *Attorney, Agent, or Firm* — Hemisphere Law, PLLC; Zhigang Ma

(57) ABSTRACT

An assembled type golf bag includes a head frame, a bottom base, a support frame, a main bag body, a lower hoop, and an upper hoop. An upper end of the support frame is detachably connected to the head frame, and a lower end of the support frame is detachably connected to the bottom base. A lower end of the main bag body is connected to the lower hoop, and an upper end of the main bag body is connected to the upper hoop. The main bag body is used to be sleeved outside the bottom base, the support frame and the head frame sequentially from bottom to top, the lower hoop on the lower end of the main bag body is detachably connected outside the bottom base, and the upper hoop on the upper end of the main bag body is detachably connected outside the head frame.

11 Claims, 8 Drawing Sheets

(56) References Cited

U.S. PATENT DOCUMENTS

| | | | | |
|---|---|---|---|---|
| 7,870,985 | B2 * | 1/2011 | King | B62J 11/05 224/430 |
| 8,100,280 | B1 * | 1/2012 | Hernandez | D06F 95/002 220/9.4 |
| 8,757,373 | B2 * | 6/2014 | Aubery | A63B 55/00 206/315.7 |
| 9,216,335 | B2 * | 12/2015 | Cheng | A63B 55/50 |
| 9,314,679 | B2 * | 4/2016 | Engel | A63B 55/40 |
| 9,586,109 | B2 * | 3/2017 | Martell | A63B 55/53 |
| 9,827,471 | B1 * | 11/2017 | Wang | A63B 55/57 |
| 10,610,751 | B2 * | 4/2020 | Martell | A63B 55/57 |
| 11,123,616 | B2 * | 9/2021 | Martell | A63B 55/20 |
| 11,167,188 | B1 * | 11/2021 | Mais | B60R 9/06 |
| 11,364,424 | B2 * | 6/2022 | Moody, Jr. | A63B 55/406 |
| 11,752,408 | B2 * | 9/2023 | Zhang | A63B 55/30 248/96 |
| 11,759,686 | B2 * | 9/2023 | Bruce | A63B 55/57 206/315.6 |
| 11,786,790 | B2 * | 10/2023 | Martell | A63B 55/40 53/411 |
| 11,911,673 | B2 * | 2/2024 | Martell | A63B 55/57 |
| 2002/0096444 | A1 * | 7/2002 | Chang | A63B 55/00 206/315.6 |
| 2004/0226839 | A1 * | 11/2004 | Su | A63B 55/60 206/315.8 |
| 2006/0108243 | A1 * | 5/2006 | Tan | A63B 55/00 206/315.6 |
| 2006/0272967 | A1 * | 12/2006 | Bremner | A63B 55/404 206/315.6 |
| 2007/0138040 | A1 * | 6/2007 | Chan | A63B 55/40 206/315.3 |
| 2008/0245689 | A1 * | 10/2008 | He | A63B 55/40 206/315.6 |
| 2010/0051489 | A1 * | 3/2010 | Shiao | A63B 55/00 206/315.7 |
| 2010/0320105 | A1 * | 12/2010 | Aubery | A63B 55/57 206/315.7 |
| 2011/0073504 | A1 * | 3/2011 | Aubery | A63B 55/00 206/315.6 |
| 2011/0078039 | A1 * | 3/2011 | Aubery | A63B 55/00 705/26.5 |
| 2014/0034527 | A1 * | 2/2014 | Anderson | A63B 55/40 206/315.6 |
| 2014/0353437 | A1 * | 12/2014 | Tan | A63B 55/50 248/96 |
| 2015/0122678 | A1 * | 5/2015 | Engel | A63B 55/40 206/315.6 |
| 2015/0209632 | A1 * | 7/2015 | Chu | A63B 55/00 206/315.6 |
| 2018/0036608 | A1 * | 2/2018 | Martell | A63B 55/57 |
| 2018/0361212 | A1 * | 12/2018 | Morton | A63B 55/40 |
| 2019/0001202 | A1 * | 1/2019 | Martell | A63B 71/021 |
| 2020/0353329 | A1 * | 11/2020 | Martell | A63B 55/57 |
| 2021/0077873 | A1 * | 3/2021 | Lai | A63B 55/40 |
| 2021/0260450 | A1 * | 8/2021 | Wang | A63B 55/50 |
| 2022/0054907 | A1 * | 2/2022 | Martell | A63B 55/57 |
| 2022/0111272 | A1 * | 4/2022 | Martell | A63B 55/53 |
| 2024/0042291 | A1 * | 2/2024 | Lai | A63B 55/57 |

FOREIGN PATENT DOCUMENTS

| | | | | | |
|---|---|---|---|---|---|
| CN | 112791362 | A | * | 5/2021 | |
| CN | 214512588 | U | * | 10/2021 | |
| CN | 214913187 | U | * | 11/2021 | A63B 55/30 |
| CN | 215691487 | U | * | 2/2022 | |
| CN | 217988305 | U | * | 12/2022 | A63B 55/40 |
| CN | 218392137 | U | * | 1/2023 | |
| DE | 102015107106 | A1 | * | 11/2016 | |
| EP | 1391224 | A1 | * | 2/2004 | A63B 55/40 |
| GB | 2375490 | A | * | 11/2002 | A63B 55/00 |
| GB | 2401554 | A | * | 11/2004 | A63B 55/00 |
| WO | WO-2009070942 | A1 | * | 6/2009 | A63B 55/00 |

* cited by examiner

ASSEMBLED TYPE GOLF BAG

TECHNICAL FIELD

The invention relates to the technical field of golf bags, in particularly to an assembled type golf bag.

BACKGROUND

As people's demands for fitness are getting higher and higher, and hobbies of sports are becoming more and more widespread, golf is more and more popular with the majority of sportsmen because of its non-intense confrontational nature and full contact between the sportsmen and nature. At present, golf bags are basically upright barrel-type structures or tilt standing golf bags through stands, which is a rather troublesome problem for users to store and transport; and for manufacturers, storage and transportation are also a major reason for pushing up production costs.

With the progress of technology, some golf bag manufacturers have gradually developed assembled type golf bags.

The Chinese patent publication No. CN112791362A disclosed an assembled type stand golf bag, including a head frame, a bag body, a bottom base, a head frame border, a bottom base border, a compartment cloth, support rods, and a support leg assembly. A partition member is fixedly arranged in the head frame, one end of the compartment cloth is fixed to the partition member in a wrapping mode, a lower end of each the support rod is inserted into an upward groove in an edge of a head side of the bottom base border, and an upper end of each the support rod is inserted into a corresponding downward groove in an edge of a head side of the bottom of the head frame border. The strip-shaped head frame border and the strip-shaped bottom base border are respectively fixed on upper and lower ends of the cylindrical bag body with two opened ends, the head frame and the head frame border as well as the bottom base and the bottom base border are snapped into a whole, and the other end of the compartment cloth is hooked and fixed on the bottom base border. One end of the support leg assembly is hooked on the head frame border, and the other end is pivotally connected to the bottom base.

When assembling the golf bag disclosed in the Chinese patent publication No. CN112791362A, firstly the bottom base and bottom base border are connected through a plurality of snap mechanisms, then the support rods are inserted on the bottom base border and the upper ends of the support rods are inserted into the head frame border, subsequently the head frame and the head frame border are connected through a plurality of snap mechanisms, and afterwards the head and the bottom of the bag body are snapped onto the head frame and the bottom base respectively, thereby completing the assembly. The assembled type stand golf bag changes the integral and undetachable stand golf bag in the related art into an assemblable and disassemblable golf bag, which is convenient to fold for packaging, store and transport.

However, a technical problem of the Chinese patent Publication No. CN112791362A is that when a consumer assembles the golf bag, an assembly connection of the bottom base with the bottom base border is complicated, an assembly connection of the head frame with the head frame border is complicated, and an assembly connection of the bag body with the head frame and the bottom base is also complicated, so that the whole assembly process of the golf bag is complicated and thus it is not easy to assemble.

SUMMARY

A technical problem to be solved by the invention is to provide an assembled type golf bag aiming at the deficiencies of the related art. The golf bag as provided can be assembled and disassembled, which is convenient to fold for package, store and transport, and has simple and easy assembly process.

In order to solve the technical problem, the invention proposes technical solutions as follows.

Specifically, an assembled type golf bag may include: a head frame, a bottom base, a support frame, a main bag body, a lower hoop, and an upper hoop. An upper end of the support frame is detachably connected to the head frame, and a lower end of the support frame is detachably connected to the bottom base. A lower end of the main bag body is connected to the lower hoop, and an upper end of the main bag body is connected to the upper hoop. The main bag body is configured (i.e., structured and arranged) to be sleeved outside the bottom base, the support frame and the head frame sequentially from bottom to top, the lower hoop on the lower end of the main bag body is detachably connected outside the bottom base, and the upper hoop on the upper end of the main bag body is detachably connected outside the head frame.

In a preferred embodiment, an outer side of the bottom base is formed with mating ring surface, an upper end of the matting ring surface is formed with a stop ring protruding outward, the lower hoop is slidably engaged outside the matting ring surface of the bottom base from bottom to top, and the stop ring is configured to limit an ending position of the lower hoop sliding upwards. Moreover, an outer side of the mating ring surface of the bottom base is formed with a vertical snapping slot, and an inner side of the lower hoop is formed with a snapping strip snappable with the snapping slot.

In a preferred embodiment, an outer side of the head frame is formed with an annular snapping groove, a plurality of snapping holes are formed on an inner side of the annular snapping groove and arranged at intervals, the upper hoop is detachably connected inside the annular snapping groove, a plurality of snapping heads are formed on an inner side of the upper hoop and arranged at intervals, a quantity of the plurality of snapping heads is matched with that of the plurality of snapping holes, and the plurality of snapping heads are configured to be snapped with the plurality of snapping holes respectively.

In a preferred embodiment, the upper hoop is formed with a hoop opening portion, the upper hoop is capable of being pulled open outward from the hoop opening portion, the upper end of the main bag body is formed with a main bag body opening portion, the upper end of the main bag body is capable of being pulled open outward from the main bag body opening portion, and a position of the main bag body opening portion corresponds to a position of the hoop opening portion. Moreover, a zipper and a buckle-type link strap are disposed on the main bag body opening portion.

In a preferred embodiment, a quantity of the plurality of snapping holes arranged at intervals and a quantity of the plurality of snapping head arranged at intervals each are in a range of 5-15, a shape of each of the plurality of snapping holes is rectangle, and each of the plurality of snapping heads includes a snapping body and snapping hooks symmetrically arranged on tow sides of the snapping body.

In a preferred embodiment, the support frame includes a middle frame, a plurality of upper connection rods, and a plurality of lower connection rods; an upper end of each of the plurality of upper connection rods is insertingly connected to the head frame, a lower end of each of the plurality of upper connection rods is insertingly connected to an upper end of the middle frame, an upper end of each of the plurality of lower connection rods is insertingly connected to a lower end of the middle frame, and a lower end of each of the lower connection rods is insertingly connected to the bottom base.

In a preferred embodiment, a quantity of the plurality of upper connection rods and a quantity of the plurality of lower connection rods each are four, first insertion holes for insertingly connecting the plurality of upper connection rods are formed on an inner wall of the head frame, second insertion holes for insertingly connecting the plurality of upper connection rods are formed on the upper end of the middle frame, third insertion holes for insertingly connecting the plurality of lower connection rods are formed on the lower end of the middle frame, and fourth insertion holes for insertingly connecting the plurality of lower connection rods are formed on the upper end of the bottom base.

In a preferred embodiment, a plurality of partition bars are disposed inside the head frame and mutually connected, the plurality of partition bars and the head frame together define a plurality of club insertion ports each for allowing a golf club to be inserted therein, and an outer side of the main bag body is disposed with a plurality of storage bags.

The invention may achieve the following beneficial effects. On one hand, because the upper end of the support frame is detachably connected to the head frame, the lower end of the support frame is detachably connected to the bottom base, the lower hoop on the lower end of the main bag body is detachably connected outside the bottom base, and the upper hoop on the upper end of main bag body is detachably connected outside the head frame, the support frame, the head frame, the bottom base, the main bag body, the lower hoop and the upper hoop of the golf bag can be assembled and disassembled, which is convenient to fold for package, store and transport. On the other hand, because the lower end of the main bag body is connected to the lower hoop, the upper end of the main bag body is connected to the upper hoop, and the main bag body is configured to be sleeved outside the bottom base, the support frame and the head frame sequentially from bottom to top, when in assembling, firstly the lower end of the support frame is insertingly connected to the bottom base and the upper end of the support frame is insertingly connected to the head frame, then the main bag body with the upper hoop and the lower hoop is sleeved upwards from the position of the bottom base until the upper hoop reaches the position of the head frame, and finally the upper loop is fixed with the head frame, thereby completing the assembly of the golf bag, the assembling process is simple and easy.

DETAILED DESCRIPTION OF EMBODIMENTS

A structural principle and a working principle of the invention will be further described in detail below with reference to the accompanying drawings.

Figure 1:
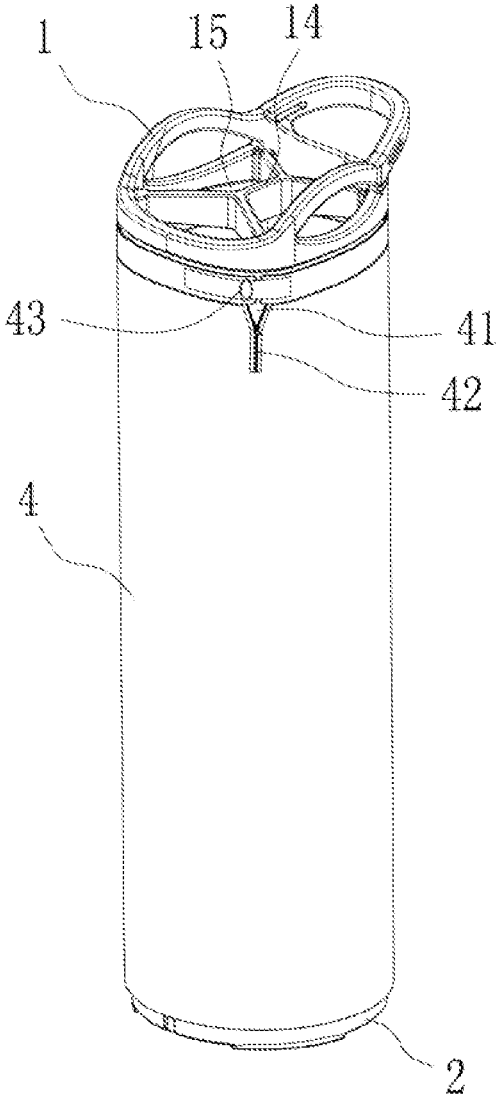
FIG. 1 illustrates a schematic view of an entire structure of a golf bag in an assembled state according to the invention.
Figure 2:
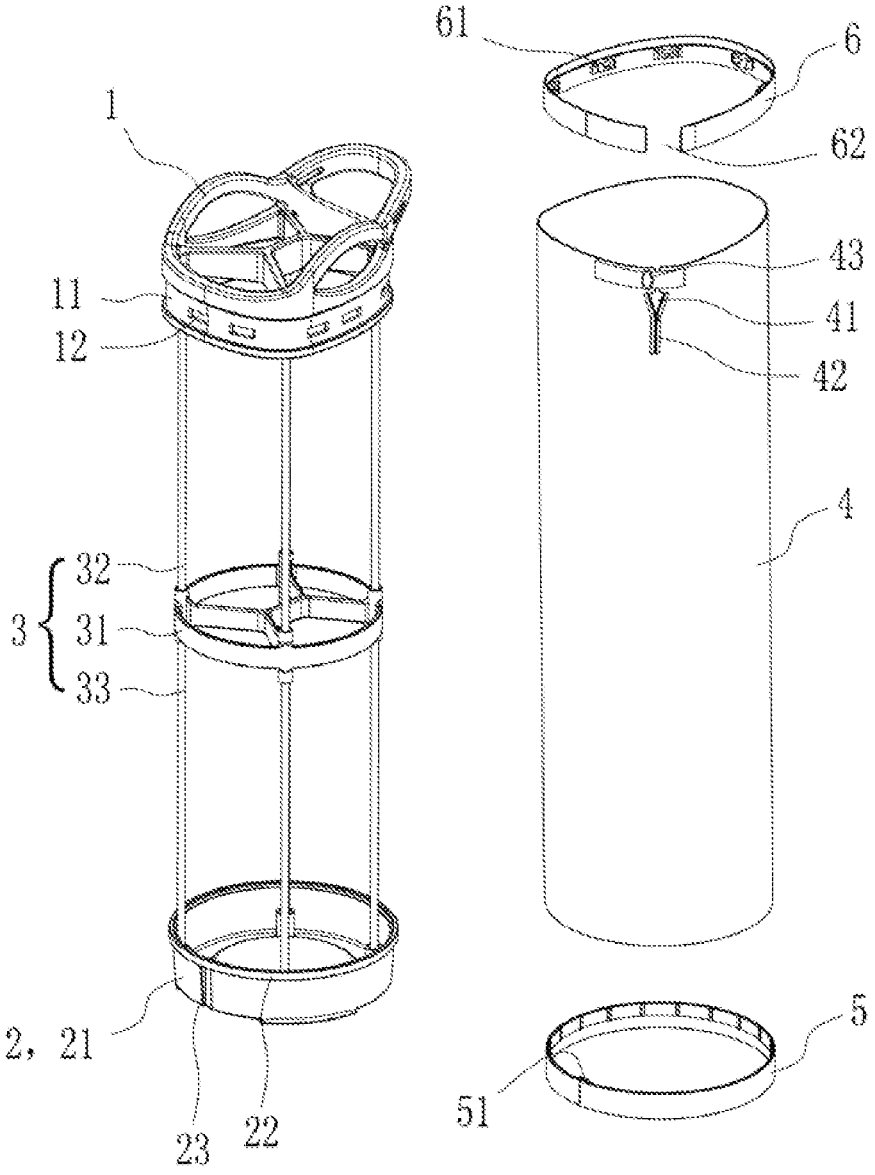
FIG. 2 illustrates a schematic view of separated structures of the golf bag in a disassembled state according to the invention.
Figure 3:
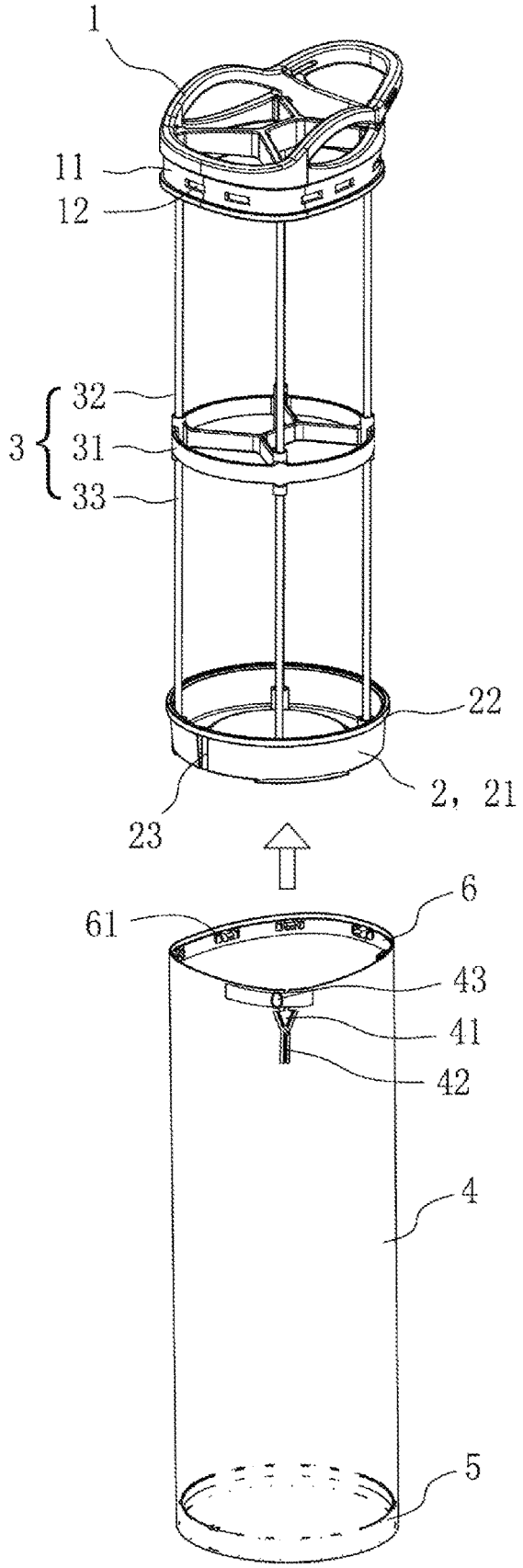
FIG. 3 illustrates a schematic view of a main bag body being sleeved outside of a bottom base, a support frame and a head frame sequentially from bottom to top according to the invention.
Figure 4:
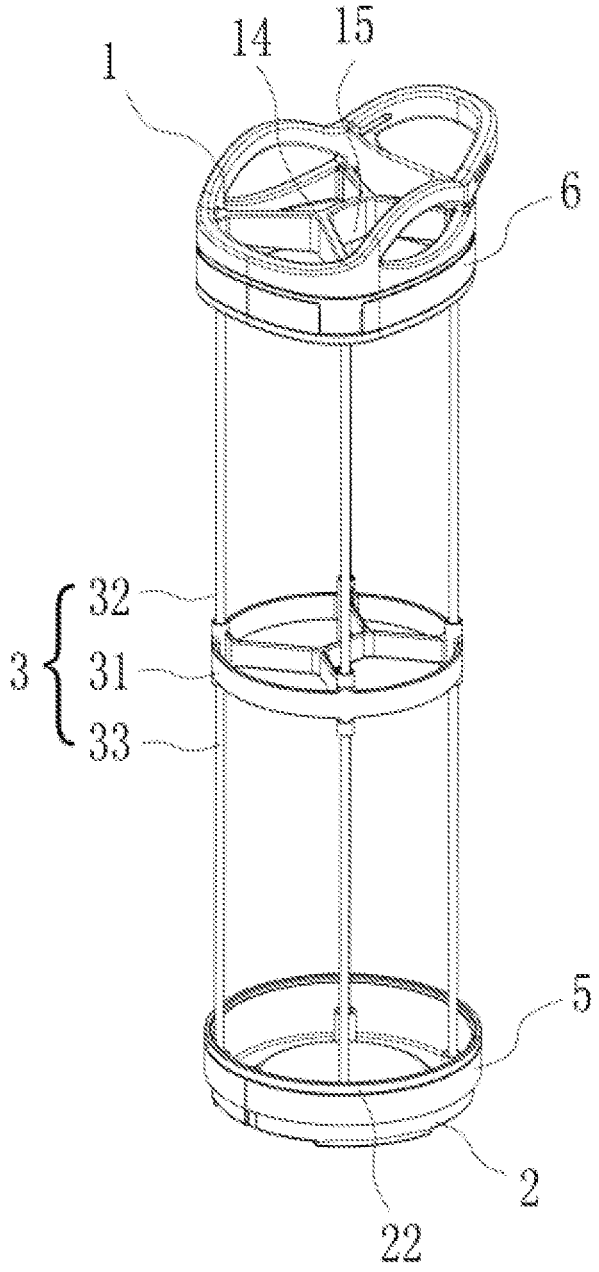
FIG. 4 illustrates a schematic structural view of the golf bag after removing the main bag body according to the invention.
Figure 5:
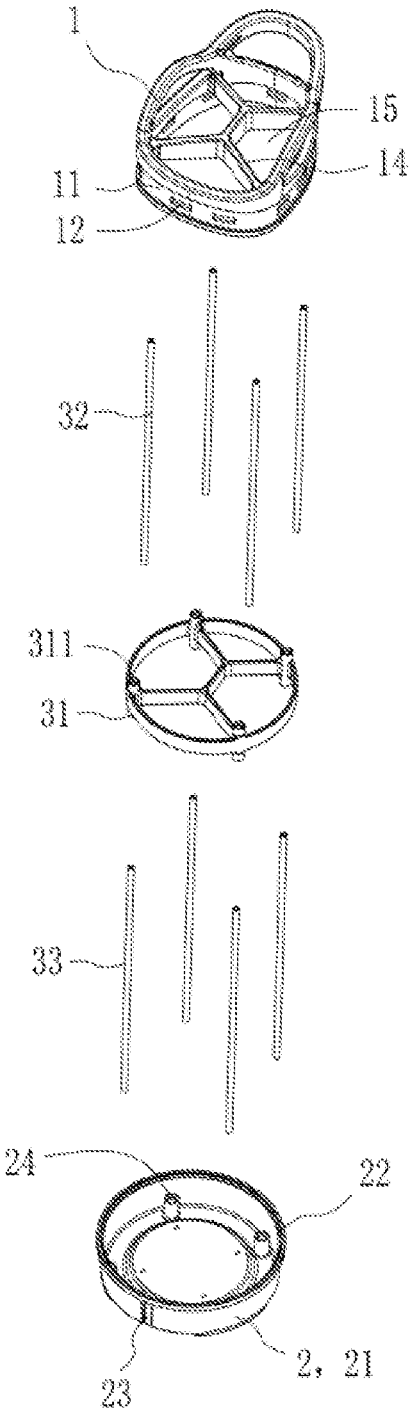
FIG. 5 illustrates a schematic view of separated structures of the head frame, the bottom base and the support frame according to the invention.
Figure 6:
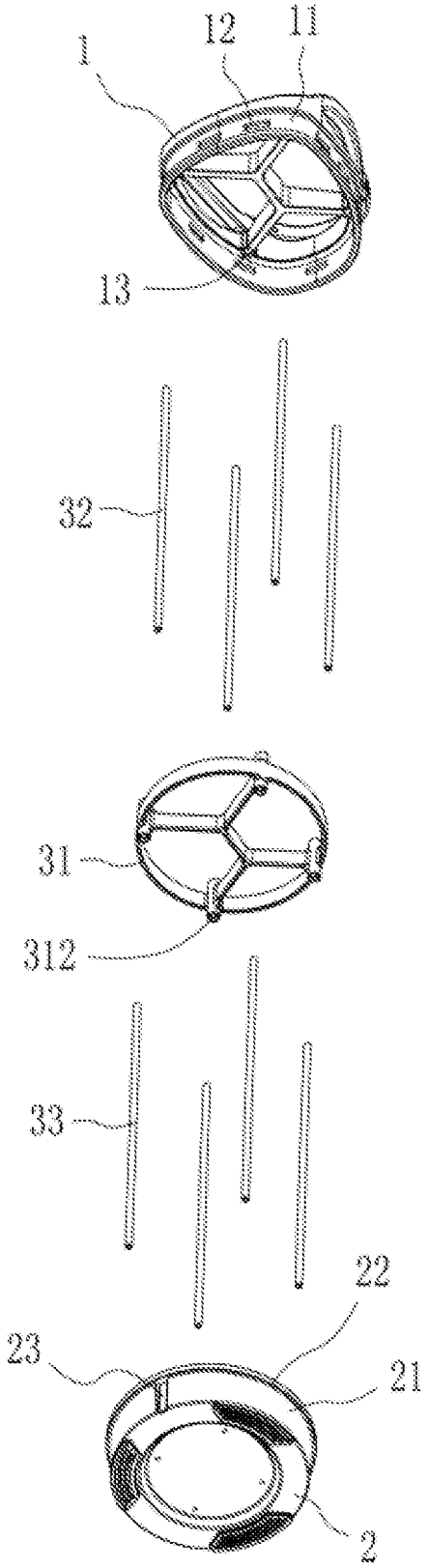
FIG. 6 illustrates another schematic view of separated structures of the head frame, the bottom base and the support frame according to the invention.
Figure 7:
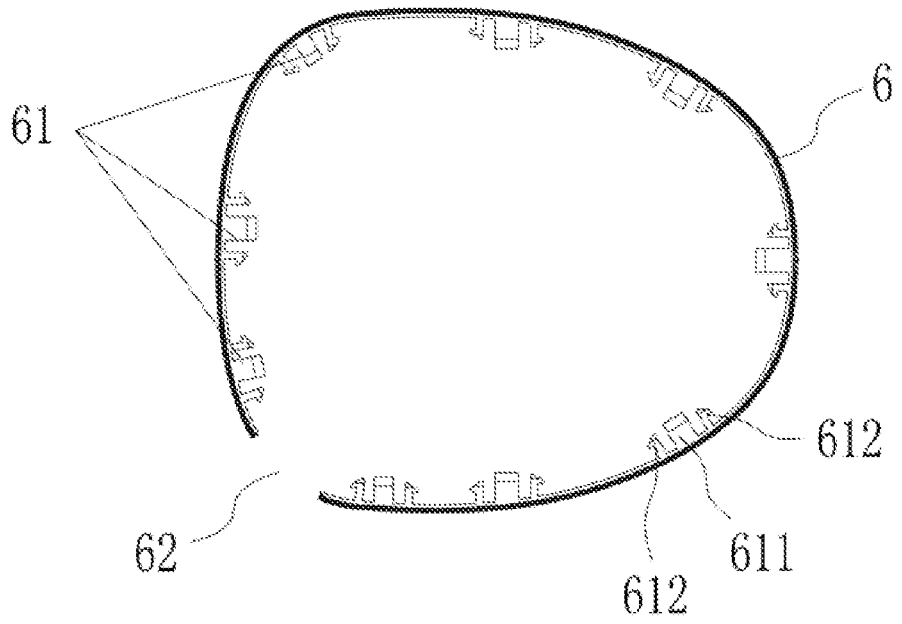
FIG. 7 illustrates a schematic top view of an upper hoop according to the invention.
Figure 8:
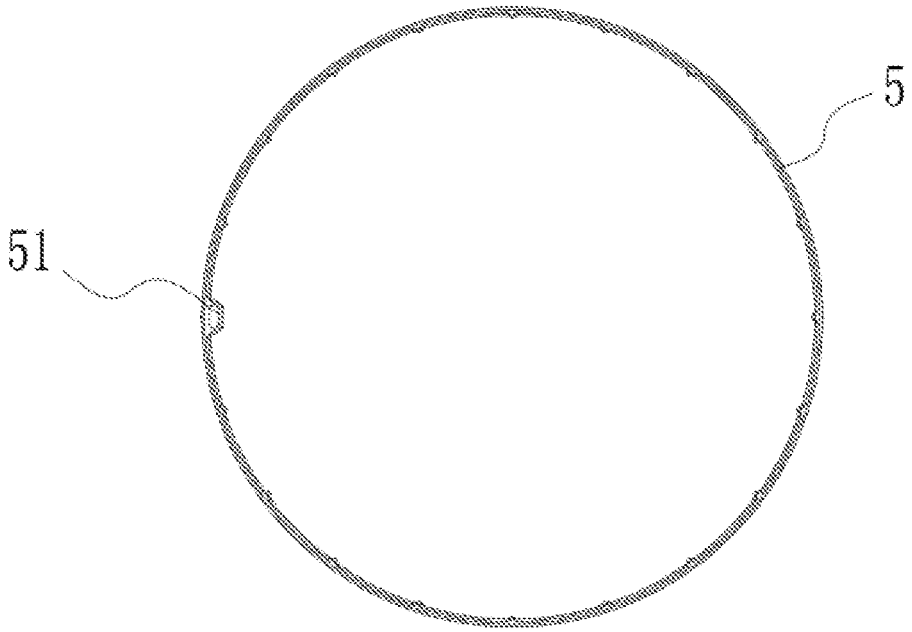
FIG. 8 illustrates a schematic top view of a lower hoop according to the invention.

As illustrated in FIG. 1 through FIG. 8, an assembled golf bag according to an embodiment of the invention includes: a head frame 1, a bottom base 2, a support frame 3, a main bag body 4, a lower hoop 5, and an upper hoop 6. An upper end of the support frame 3 is detachably connected to the head frame 1, and a lower end of the support frame 3 is detachably connected to the bottom base 2. A lower end of the main bag body 4 is connected to the lower hoop 5, and an upper end of the main bag body 4 is connected to the upper hoop 6. The main bag body 4 is sequentially sleeved outside the bottom base 2, the support frame 3 and the head frame 1 from bottom to top. The lower hoop 5 on the lower end of the main bag body 4 is detachably connected outside the bottom base 2, and the upper hoop 6 on the upper end of the main bag body 4 is detachably connected outside the head frame 1. As illustrated in FIG. 3, In assembling the golf bag, firstly, the lower end of the support frame 3 is insertingly connected to the bottom base 2, and the upper end of the support frame 3 is insertingly connected to the head frame 1; afterwards, the main bag body 4 with the upper hoop 6 and the lower hoop 5 is sleeved upwards from the position of the bottom base 2 until the upper hoop 6 reaches the position of the head frame 1; and finally, the upper hoop 6 is fixed to the head frame 1, thereby completing the assembly of the golf bag (as shown in FIG. 1), and the assembling process is simple and easy.

As illustrated in FIG. 2 through FIG. 6 and FIG. 8, an outer side of the bottom base 2 is provided with a mating ring surface 21, and an upper end of the mating ring surface 21 is provided with a stop ring 22 protruding outwards. The lower hoop 5 is slid from bottom to top and is engaged outside the mating ring surface 21 of the bottom base 2, and the stop ring 22 is configured (i.e., structured and arranged) to limit an ending position of upward sliding of the lower hoop 5. In assembling, when the main bag body 4 pulls the lower hoop 5 to move upwards, the lower hoop 5 is directly slidably engaged outside the mating ring surface 21 of the bottom base 2, and the employment of the slidably engaged structure of the mating ring surface 21 with the lower hoop 5 makes the assembly is very convenient. Preferably, an outer side of the mating ring surface 21 of the bottom base 2 is formed with a vertical snapping slot 23, an inner side of the lower hoop 5 is formed with a snapping strip 51 snappable with the snapping slot 23, and the employment of the snappable structure of the snapping slot 23 with the snapping strip 51 can ensure a correct snapping direction of the bottom base 2 with the lower hoop 5.

As illustrated in FIG. 2 through FIG. 7, an outer side of the upper hoop 6 is formed with an annular snapping groove 11, and several snapping holes 12 are formed in the annular snapping groove 11 at intervals. The upper hoop 6 is detachably connected inside the annular snapping groove 11, and several snapping heads 61 are formed on an inner side of the upper hoop 6 at intervals. The number of the snapping heads 61 is matched with that of the snapping holes 12, and the snapping heads 61 are snapped with the snapping holes 13, respectively. A hoop opening portion 62 is formed on the upper hoop 6, and the upper hoop 6 can be pulled open outwards from the hoop opening portion 62. A main bag body opening portion 41 is formed on the upper end of the main bag body 4, the upper end of the main bag body 4 can be pulled open outwards from the main bag body opening portion 41, and the position of the main bag body opening portion 41 corresponds to the position of the hoop opening portion 62. A zipper 42 and a buckle-type link strap 43 are disposed at the main bag body opening portion 41. In assembling the golf bag, when the main bag body 4 with the upper hoop 6 and the lower hoop 5 is sleeved upwards from the position of the bottom base 2 until the upper hoop 6 reaches the position of the head frame 1, firstly, the upper hoop 6 is placed inside the annular snapping groove 11 and the snapping heads 61 of the upper hoop 6 are made to be snapped with the snapping holes 12; and after that, the zipper 42 is pulled up and the buckle-type link strap 43 is tightly fastened. In some embodiments of the invention, the snapping holes 12 as well as the snapping heads 61 are 9-15 in quantity arranged at intervals, and in the illustrated embodiment, the snapping holes 12 as well as the snapping heads 61 are 9 in quantity, a shape of each the snapping hole 12 is rectangle, and each the snapping head 61 includes a snapping body 611 and snapping hooks 612 symmetrically arranged on two sides of the snapping body 611.

As illustrated in FIG. 2 through FIG. 6, the support frame 3 includes: a middle frame 31, several upper connection rods 32, and several lower connection rods 33. An upper end of each the upper connection rod 32 is insertingly connected to the head frame 1, a lower end of each the upper connection rod 32 is insertingly connected to an upper end of the middle frame 31, an upper end of each the lower connection rod 33 is insertingly connected to a lower end of the middle frame 31, and a lower end of each the lower connection rod 33 is insertingly connected to the bottom base 2. As such, the middle frame 31, the upper connection rods 32 and the lower connection rods 33 of the support frame 3 can be assembled and disassembled with each other, which can further facilitate folding for packing, storage and transportation.

As illustrated in FIG. 2 through FIG. 6, the upper connection rods 32 are four in quantity, and the lower connection rods 33 are four in quantity. An inner wall of the head frame 1 is formed with first insertion holes 13 for insertingly connecting with the upper connection rods 32, the upper end of the middle frame 31 is formed with second insertion holes 311 for insertingly connecting with the upper connection rods 32, the lower end of the middle frame 31 is formed with third insertion holes 312 for insertingly connecting with the lower connection rods 33, and the upper end of the bottom base 2 is formed with fourth insertion holes 24 for insertingly connecting with the lower connection rods 33, thereby making the installation of the upper connection rods 32 and the lower connection rods 33 be very stable.

Figure 9:
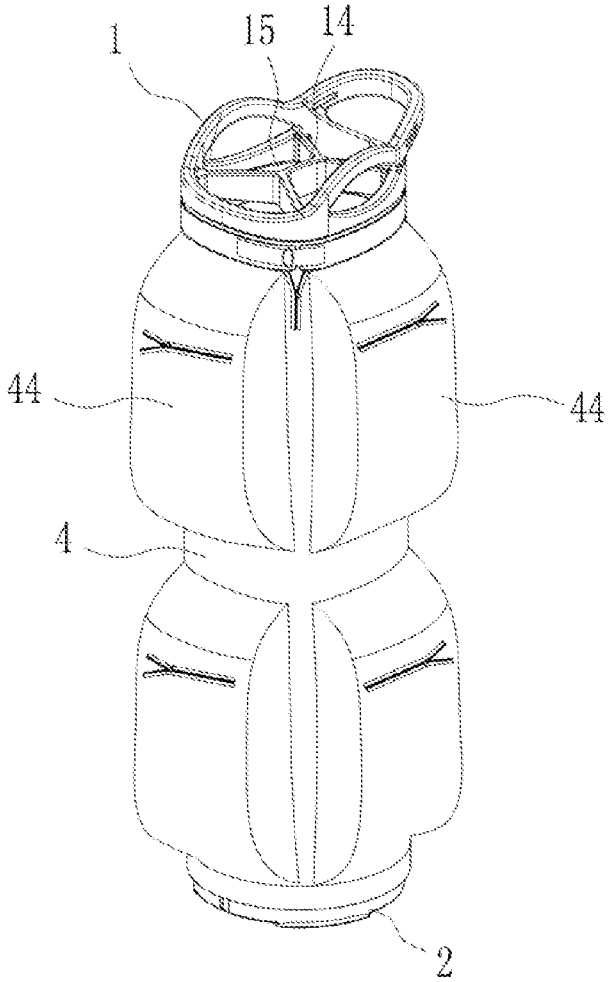
FIG. 9 illustrates a schematic view of an entire structure of a golf bag according to a preferred embodiment of the invention.

As illustrated in FIG. 1 through FIG. 6, several mutually connected partition bars 14 are disposed inside the head frame 1, and the partition bars 14 and the head frame 1 together define several club insertion ports 15 for allowing a golf club to be inserted therein. As illustrated in FIG. 9, an outer side of the main bag body 4 may be provided with several storage bags 44.

The above is only preferred embodiments of the invention, and any minor amendment, and equivalent change and modification made to the above embodiments according to the technical solutions of the invention are within the scope of protection of the invention.

What is claimed is:

1. An assembled type golf bag, comprising: a head frame, a bottom base, a support frame, a main bag body, a lower hoop, and an upper hoop;

wherein an upper end of the support frame is detachably connected to the head frame, and a lower end of the support frame is detachably connected to the bottom base;

wherein a lower end of the main bag body is connected to the lower hoop, and an upper end of the main bag body is connected to the upper hoop;

wherein the main bag body is configured to be sleeved outside the bottom base, the support frame and the head frame sequentially from bottom to top, the lower hoop on the lower end of the main bag body is detachably connected outside the bottom base, and the upper hoop on the upper end of the main bag body is detachably connected outside the head frame;

wherein an outer wall of the head frame is formed with an annular snapping groove-shaped part, a plurality of snapping holes are formed on the annular snapping groove-shaped part and arranged at intervals, the upper hoop is detachably connected to and embedded into the annular snapping groove-shaped part; a plurality of snapping heads are formed on an inner side of the upper hoop and arranged at intervals, each of the plurality of snapping heads extends in a radial direction of the upper hoop, a quantity of the plurality of snapping heads is matched with that of the plurality of snapping holes, and the plurality of snapping heads are configured to be snapped with the plurality of snapping holes respectively; and each of the plurality of snapping heads comprises a snapping body and two snapping hooks symmetrically arranged on two sides of the snapping body, each of the two snapping hooks comprises a hook body and a protrusion connected to the hook body, and the protrusion is disposed to protrude from a side of the hook body facing away from the snapping body.

2. The assembled type golf bag as claimed in claim 1, wherein an outer side of the bottom base is formed with mating ring surface, an upper end of the matting ring surface is formed with a stop ring protruding outward, the lower hoop is slidably engaged outside the matting ring surface of the bottom base from bottom to top, and the stop ring is configured to limit an ending position of the lower hoop sliding upwards.

3. The assembled type golf bag as claimed in claim 2, wherein an outer side of the mating ring surface of the bottom base is formed with a vertical snapping slot, and an inner side of the lower hoop is formed with a snapping strip snappable with the snapping slot.

4. The assembled type golf bag as claimed in claim 1, wherein the upper hoop is formed with a hoop opening portion, the upper hoop is capable of being pulled open outward from the hoop opening portion, the upper end of the main bag body is formed with a main bag body opening portion, the upper end of the main bag body is capable of being pulled open outward from the main bag body opening portion, and a position of the main bag body opening portion corresponds to a position of the hoop opening portion.

5. The assembled type golf bag as claimed in claim 4, wherein a zipper and a buckle-type link strap are disposed on the main bag body opening portion.

6. The assembled type golf bag as claimed in claim 1, wherein a quantity of the plurality of snapping holes arranged at intervals and a quantity of the plurality of snapping head arranged at intervals each are in a range of 5-15, a shape of each of the plurality of snapping holes is rectangle.

7. The assembled type golf bag as claimed in claim 1, wherein the support frame comprises a middle frame, a plurality of upper connection rods, and a plurality of lower connection rods; an upper end of each of the plurality of upper connection rods is insertingly connected to the head frame, a lower end of each of the plurality of upper connection rods is insertingly connected to an upper end of the middle frame, an upper end of each of the plurality of lower connection rods is insertingly connected to a lower end of the middle frame, and a lower end of each of the lower connection rods is insertingly connected to the bottom base.

8. The assembled type golf bag as claimed in claim 7, wherein a quantity of the plurality of upper connection rods and a quantity of the plurality of lower connection rods each are four, first insertion holes for insertingly connecting the plurality of upper connection rods are formed on an inner wall of the head frame, second insertion holes for insertingly connecting the plurality of upper connection rods are formed on the upper end of the middle frame, third insertion holes for insertingly connecting the plurality of lower connection rods are formed on the lower end of the middle frame, and fourth insertion holes for insertingly connecting the plurality of lower connection rods are formed on the upper end of the bottom base.

9. The assembled type golf bag as claimed in claim 1, wherein a plurality of partition bars are disposed inside the head frame and mutually connected, the plurality of partition bars and the head frame together define a plurality of club insertion ports each for allowing a golf club to be inserted therein, and an outer side of the main bag body is disposed with a plurality of storage bags.

10. An assembled type golf bag, comprising: a head frame, a bottom base, a support frame, a main bag body, a lower hoop, and an upper hoop;

wherein an upper end of the support frame is detachably connected to the head frame, and a lower end of the support frame is detachably connected to the bottom base;

wherein a lower end of the main bag body is connected to the lower hoop, and an upper end of the main bag body is connected to the upper hoop;

wherein the main bag body is configured to be sleeved outside the bottom base, the support frame and the head frame sequentially from bottom to top, the lower hoop on the lower end of the main bag body is detachably connected outside the bottom base, and the upper hoop on the upper end of the main bag body is detachably connected outside the head frame;

wherein the upper hoop has a first end and a second end, a gap is defined between the first end and the second end, the gap is configured to make the upper hoop to be pulled open outward; the upper end of the main bag body defines a main bag body opening, the main bag body opening extends in an length-wise direction of the main bag body from the head frame to the bottom base but does not reach the bottom base, the main bag body opening is configured to make be pulled open outward, and a position of the main bag body opening corresponds to a position of the gap;

wherein a zipper is disposed at the main bag body opening and is configured to close the main bag body, a buckle-type link strap are disposed above the main bag body opening and corresponds to the upper hoop in position.

11. An assembled type golf bag, comprising: a head frame, a bottom base, a support frame, a main bag body, a lower hoop, and an upper hoop;

wherein an upper end of the support frame is detachably connected to the head frame, and a lower end of the support frame is detachably connected to the bottom base;

wherein a lower end of the main bag body is connected to the lower hoop, and an upper end of the main bag body is connected to the upper hoop;

wherein the main bag body is configured to be sleeved outside the bottom base, the support frame and the head frame sequentially from bottom to top, the lower hoop on the lower end of the main bag body is detachably connected outside the bottom base, and the upper hoop on the upper end of the main bag body is detachably connected outside the head frame;

wherein the support frame comprises a middle frame, a plurality of upper connection rods, and a plurality of lower connection rods; an upper end of each of the plurality of upper connection rods is insertingly connected to the head frame, a lower end of each of the plurality of upper connection rods is insertingly connected to an upper end of the middle frame, an upper end of each of the plurality of lower connection rods is insertingly connected to a lower end of the middle frame, and a lower end of each of the lower connection rods is insertingly connected to the bottom base;

wherein a plurality of first partition bars are disposed inside the head frame and mutually connected, a plurality of second partition bars are disposed inside the middle frame and mutually connected, the plurality of first partition bars and the head frame together define a plurality of first club insertion ports each for allowing a golf club to be inserted therein, the plurality of second partition bars and the middle frame together define a plurality of second club insertion ports each for allowing a golf club to be inserted therein, a quantity of the plurality of first club insertion ports is equal to a quantity of the plurality of second club insertion ports, and the plurality of first club insertion ports respectively correspond to the plurality of second club insertion ports in position.

* * * * *